US008777824B2

(12) United States Patent
Kimata

(10) Patent No.: US 8,777,824 B2
(45) Date of Patent: Jul. 15, 2014

(54) SHEET FOLDING DEVICE, IMAGE FORMING APPARATUS, AND SHEET FOLDING METHOD

(75) Inventor: Masanobu Kimata, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 690 days.

(21) Appl. No.: 12/929,562

(22) Filed: Feb. 1, 2011

(65) Prior Publication Data

US 2011/0190109 A1 Aug. 4, 2011

(30) Foreign Application Priority Data

Feb. 4, 2010 (JP) ..... 2010-023320
Oct. 15, 2010 (JP) ..... 2010-232758

(51) Int. Cl.
*B31F 1/08* (2006.01)
*B65H 45/18* (2006.01)
*B65H 45/14* (2006.01)

(52) U.S. Cl.
CPC *B31F 1/08* (2013.01); *B65H 45/18* (2013.01); *B65H 45/14* (2013.01); *B65H 2301/1421* (2013.01); *B65H 2801/27* (2013.01)
USPC ..... 493/23; 493/25; 493/37; 493/419

(58) Field of Classification Search
CPC ..... B65H 2801/27; B65H 2511/152; B65H 2511/13; B65H 2301/1421; B65H 2301/144; B65H 2301/142; B65H 2301/14; B65H 37/06; B65H 45/147; B65H 45/144; B65H 45/142; B65H 45/14; B65H 45/18; B31F 1/08
USPC ..... 493/8, 23, 25, 37, 419, 420, 421, 443, 493/444
IPC ..... B31F 1/08; B65H 45/18
See application file for complete search history.

(56) References Cited

U.S. PATENT DOCUMENTS

| | | | | |
|---|---|---|---|---|
| 3,901,501 | A * | 8/1975 | Kistner | 493/444 |
| 4,101,121 | A * | 7/1978 | Rastorguyeff | 493/37 |
| 4,643,705 | A * | 2/1987 | Bober | 493/444 |
| 4,746,108 | A * | 5/1988 | Hirayama et al. | 493/437 |
| 5,322,498 | A * | 6/1994 | Lehmann et al. | 493/420 |
| 6,746,390 | B2 * | 6/2004 | Tamura et al. | 493/23 |
| 7,537,556 | B2 * | 5/2009 | Bober | 493/23 |
| 7,694,966 | B2 * | 4/2010 | Nagasako et al. | 271/303 |
| 7,731,187 | B2 | 6/2010 | Horio et al. | |
| 2009/0062100 | A1 | 3/2009 | Takekawa et al. | |
| 2009/0129840 | A1 | 5/2009 | Takekawa et al. | |
| 2010/0252981 | A1 | 10/2010 | Kimata et al. | |

FOREIGN PATENT DOCUMENTS

| | | | | |
|---|---|---|---|---|
| EP | 595105 | A1 * | 5/1994 | B65H 45/14 |
| JP | 09183568 | A * | 7/1997 | B65H 45/18 |
| JP | 2001206629 | A | 7/2001 | |
| JP | 2002284443 | A | 10/2002 | |
| JP | 2007320665 | A | 12/2007 | |

* cited by examiner

*Primary Examiner* — Stephen F Gerrity
(74) *Attorney, Agent, or Firm* — Harness, Dickey & Pierce, PLC

(57) ABSTRACT

A sheet folding device for performing single-sheet folding and multi-sheet folding with a single feed path, the device including: a conveying unit that conveys a sheet; a restraining unit that stops a leading edge of the sheet; a pair of folding rollers that fold the sheet; and a guiding member that guides a bend of the sheet to a nip between the pair of folding rollers, wherein the guiding member is positioned at different sheet-guiding positions for single-sheet folding and multi-sheet folding.

10 Claims, 8 Drawing Sheets

SHEET FOLDING DEVICE, IMAGE FORMING APPARATUS, AND SHEET FOLDING METHOD

CROSS-REFERENCE TO RELATED APPLICATIONS

The present application claims priority to and incorporates by reference the entire contents of Japanese Patent Application No. 2010-023320 filed in Japan on Feb. 4, 2010 and Japanese Patent Application No. 2010-232758 filed in Japan on Oct. 15, 2010.

BACKGROUND OF THE INVENTION

1. Field of the Invention

The present invention generally relates to a sheet folding device, an image forming apparatus, and a sheet folding method.

2. Description of the Related Art

Various types of sheet feeding apparatuses have been proposed which perform folding processing, followed by post-processing such as punching and stapling, on sheets on which images are formed by a copying machine or other image forming apparatus. Examples of such apparatuses include the known invention described in Japanese Patent Application Laid-open No. 2002-284443. Japanese Patent Application Laid-open No. 2002-284443 describes a sheet folding device which has two folding rollers that are arranged next to and in parallel with each other and rotate in opposite directions to form a fold in a predetermined position of a sheet such as a form, wherein a sheet or a stack of a plurality of sheets is curved and the curved portion of the sheet(s) is taken into between the two folding rollers to form the fold in the sheet(s). The sheet folding device includes: a conveying unit that conveys the sheet(s) so as to pass near adjoining portions of the two folding rollers; a guiding member that changes the course of the leading edge(s) of the sheet(s) so that the sheet(s) conveyed by the conveying unit is/are curved toward the adjoining portions of the folding rollers near the adjoining portions; a stopper that stops movement of the leading edge(s) of the sheet(s) whose moving direction is changed by the guiding member, thereby directing the curved portion of the sheet(s) toward the adjoining portions of the folding rollers; and a folding position restraining member that makes contact with an inner side of the curved portion of the sheet(s) when the sheet(s) is/are curved by the guiding member, thereby increasing the curvature of the curved portion of the sheet(s) before the leading edge(s) of the sheet(s) comes/come into contact with the stopper and bringing the curved portion close to the adjoining portions of the folding rollers to restrain the folding position of the sheet(s).

Related inventions are also described in Japanese Patent Application Laid-open No. 2001-206629 and Japanese Patent Application Laid-open No. 2007-320665.

In the invention described in Japanese Patent Application Laid-open No. 2002-284443, the guiding member is moved by a driving unit regardless of single-sheet folding or multi-sheet folding. The guiding member is thereby brought close to the folding roller nip for the sake of the prevention of folding position errors. According to such a method, single-sheet folding of feeding and folding a single sheet can be successfully performed because the sheet can fall to the position restraining member without fail. In the case of multi-sheet folding where a plurality of sheets are pre-stacked, however, the gap between the guiding member and the sheets may decrease depending on the thickness and curl of the sheets. The smaller gap increases the feeding resistance, and the sheets sometimes fail to fall to the position restraining member. Japanese Patent Application Laid-open No. 2001-206629 and Japanese Patent Application Laid-open No. 2007-320665 include no particular consideration to securing the fall, either.

In the embodiment to be described later, the single feed path corresponds to a second conveying path 17; the conveying unit to the carriage rollers; the restraining unit to a first stopper 23; the guiding member to a movable guide plate 60; the sheet folding device to the reference numeral 5; the driving unit to a pusher member 27, a second motor 57, and a tension spring 61; the control unit to a control unit 56; the elastic body to the tension spring 61; the pusher member to the reference numeral 27; the single driving source to the second motor 57; and the image forming apparatus to an image forming apparatus 1 as a system.

SUMMARY OF THE INVENTION

It is an object of the present invention to at least partially solve the problems in the conventional technology.

According to an aspect of the present invention, there is provided a sheet folding device for performing single-sheet folding and multi-sheet folding with a single feed path, the device including: a conveying unit that conveys a sheet; a restraining unit that stops a leading edge of the sheet; a pair of folding rollers that fold the sheet; and a guiding member that guides a bend of the sheet to a nip between the pair of folding rollers, wherein the guiding member is positioned at different sheet-guiding positions for single-sheet folding and multi-sheet folding.

According to still another aspect of the present invention, there is provided a sheet folding method for performing single-sheet folding and multi-sheet folding with a single feed path, the method including: conveying a sheet by a conveying unit; restraining a leading edge of the conveyed sheet by a restraining unit; and guiding by a guiding member a bend of the sheet in the restrained state into a nip between a pair of folding rollers for sheet folding, thereby folding the sheet, wherein in the guiding, the guiding member is positioned at different sheet-guiding positions for single-sheet folding and multi-sheet folding.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the present invention, the guide plate is made movable in order to secure a feeding gap for multi-sheet folding, and the feeding gap is increased so as not to produce a feeding friction (resistance) when a bundle of sheets increases in thickness. This makes it possible to fold the sheets with high alignment accuracy without being affected by the thickness or curl of the bundle of sheets. Hereinafter, an embodiment of the present invention will be described with reference to the drawings.

Figure 1:
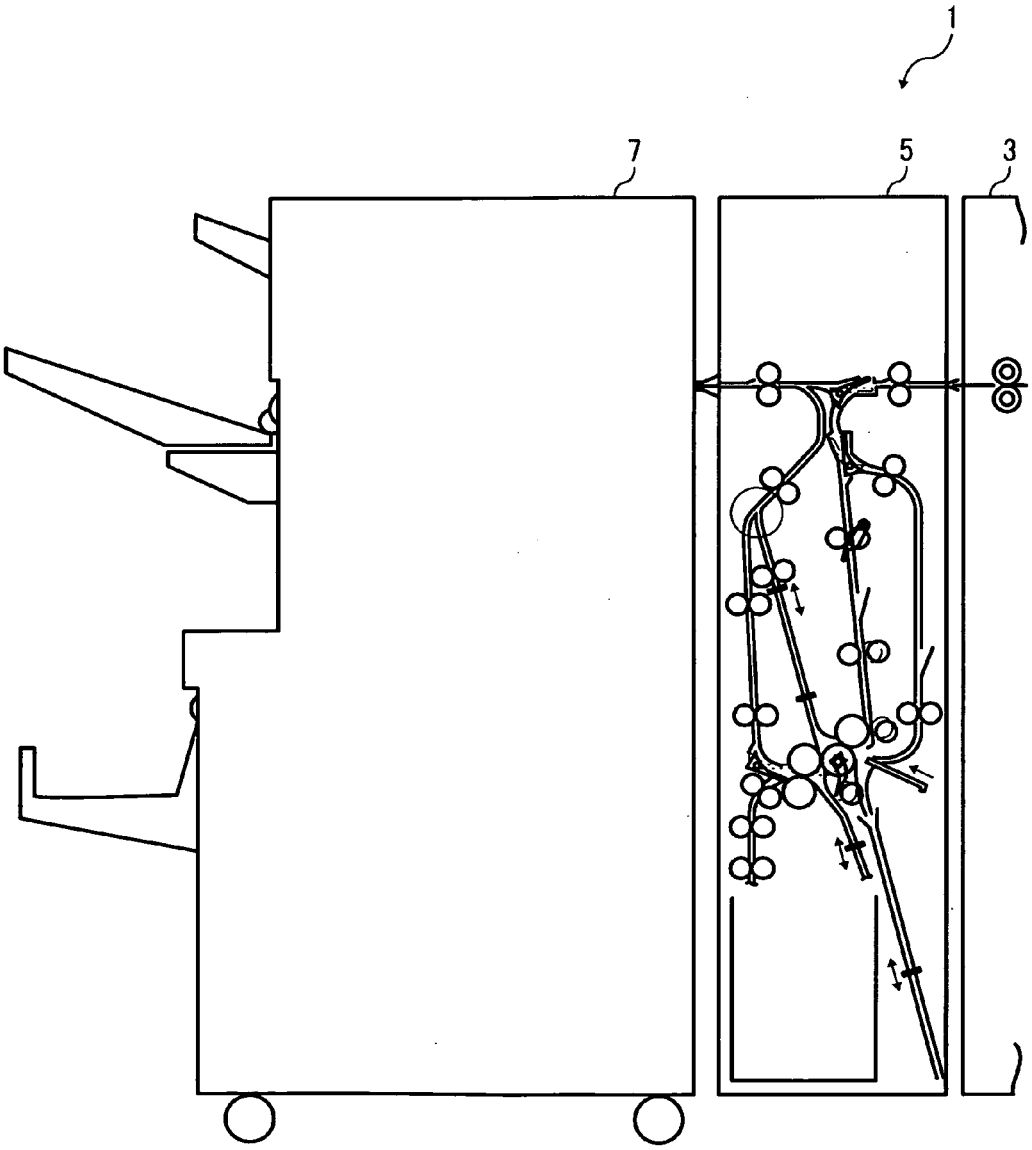
FIG. 1 is a diagram showing a system configuration of an image forming apparatus according to an embodiment of the present invention.

FIG. 1 is a diagram showing the configuration of an image forming apparatus according to the embodiment of the present invention. The image forming apparatus 1 according to the present embodiment includes an image forming apparatus body 3, a sheet folding device 5, and a sheet postprocessing device 7. The image forming apparatus body 3 is composed of any one of the following: a copying machine, a printer, a facsimile, and a digital MFP that has the functions of at least two of the machines in combination. In the present embodiment, the image forming apparatus body 3 is composed of a copying machine which includes the following: an image reading unit that reads an original image; an image forming unit that forms the original image read by the image reading unit on a sheet; a paper feeding unit that accommodates sheets to be fed to the image forming unit; a discharging unit that discharges the sheet on which the image is formed by the image forming unit; a control unit 56 that controls the components of the apparatus body; and an operation panel 4 (see FIG. 12) that transmits an operation signal to the control unit 56.

The sheet, or the image-formed sheet fed from the image forming apparatus body 3 here, is subjected to folding processing in the sheet folding device 5 if needed. If no folding processing is needed in the sheet folding device 5, the sheet is fed to the sheet postprocessing device 7, bypassing the sheet folding device. The sheet postprocessing device 7 has known functions and mechanisms. For example, the sheet postprocessing device 7 is capable of such processing as punching, alignment processing, side stitching, center folding, saddle stitching, and sorting.

Figure 2:
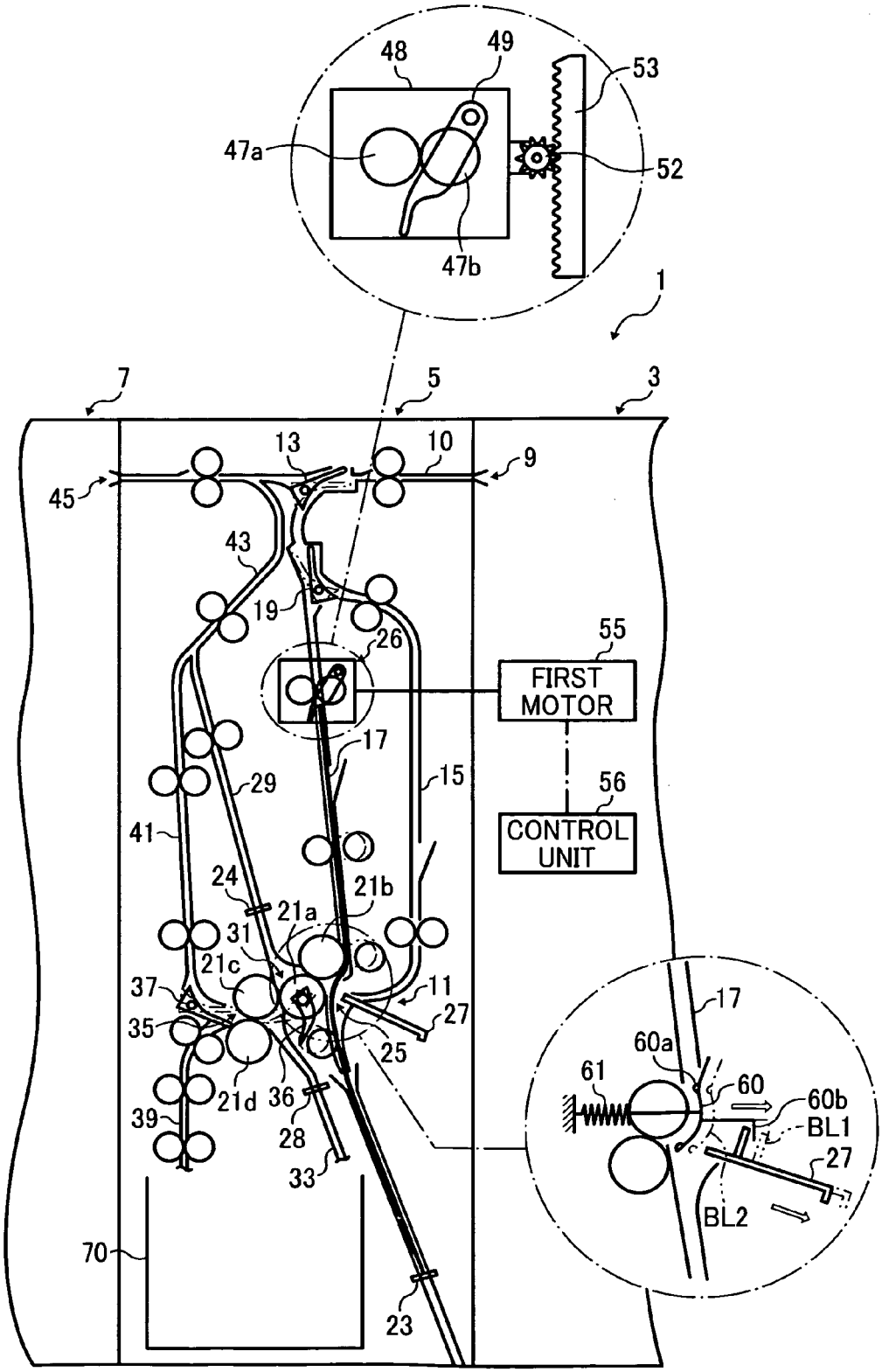
FIG. 2 is an explanatory diagram for explaining the folding operation of a sheet folding device according to the system configuration of FIG. 1, showing a state where a bundle of sheets is retained in a second conveying path.

FIG. 2 is a longitudinal sectional view showing the internal configuration of the sheet folding device according to the present embodiment in detail. Some parts of FIG. 1 are shown enlarged in FIG. 2. In FIG. 2, the sheet folding device 5 has a straight conveying path 10 for discharging a sheet straight from a sheet inlet port 9 to a sheet discharge port 45. When folding a sheet, the feeding direction is switched from the straight conveying path 10 to a folding processing section side by a first switching claw 13. The folded sheet is returned to the straight conveying path 10 from a seventh conveying path 43 on the downstream side of the installation location of the first switching claw 13, and fed to the sheet postprocessing device 7 from the discharge port 45.

The conveying path branching off at the first switching claw 13 is composed of a first conveying path 15, a second conveying path 17, a third conveying path 29, a fourth conveying path 33, a fifth conveying path 39, a sixth conveying path 41, and the seventh conveying path 43. A second switching claw 19 for switching the sheet feeding destination between the first conveying path 15 and the second conveying path (reservoir unit) 17 is arranged on the downstream side of the first switching claw 13, on the way to a sheet folding section 11. The downstream end of the first conveying path 15 is merged with the second conveying path 17. A first pair of folding rollers 21*a* and 21*b* are arranged near the junction. A first stopper (receiving member) 23, which is movable in the sheet feeding direction and intended to restrain the leading edges of sheets, is arranged on the downstream side of the second conveying path 17. Sheets can be reserved in the second conveying path 17 with the leading edges of the sheets in contact with the first stopper 23.

A pusher member 27 is arranged in a position opposed to a first folding nip 25 between the first pair of folding rollers 21*a* and 21*b*. The pusher member 27 is intended to guide the leading edge of the sheet that is fed along the first conveying path 15, or push the sheets retained in the second conveying path 17, into the first folding nip 25. A moving roller unit 26 for conveying a sheet is arranged on the second conveying path 17, between the second switching claw 19 and the first folding nip 25.

The third conveying path 29 and a second pair of folding rollers 21*a* and 21*c* are arranged on the downstream side of the first folding nip 25. The fourth conveying path 33 and a third pair of folding rollers 21*c* and 21*d* are arranged on the downstream side of a second folding nip 31 between the second pair of folding rollers 21*a* and 21*c*. A third switching claw 36 for switching the sheet feeding destination between the fourth conveying path 33 and a third folding nip 35 of the third pair of folding rollers 21*c* and 21*d* is attached to the shaft of the folding roller 21*a*.

A switching claw 37 for switching the sheet feeding destination between the fifth conveying path 39 and the sixth conveying path 41 is arranged on the downstream side of the third folding nip 35. The downstream end of the fifth conveying path 39 is connected to a stacker 70 so that bundles of folded sheets can be discharged. The sixth conveying path 41 is merged with the downstream end of the third conveying path 29 so as to communicate with the seventh conveying path 43.

The first conveying path 15, the second conveying path 17, the third conveying path 29, the fifth conveying path 39, the sixth conveying path 41, and the seventh conveying paths 43 are equipped with pairs of carriage rollers for conveying sheets. Second and third stoppers 24 and 28 similar to the first stopper 23 are arranged on the third and fourth conveying paths 29 and 33 so as to be extensible and retractable into/from the conveying paths and movable in the sheet feeding directions.

As shown enlarged in FIG. 2, the moving roller unit 26 includes a pair of carriage rollers 47*a* and 47*b* which are pressed against each other, a retainer member 49 for pressing the trailing edges of the sheets retained in the second conveying path 17, and a frame 48 which holds such components. The shafts of the pair of carriage rollers 47*a* and 47*b* are rotatably supported at both ends by a front side plate and a rear side plate of the frame 48, respectively. The pair of carriage rollers 47*a* and 47*b* are each composed of a plurality of rollers that are arranged on the same shaft at predetermined intervals in the sheet width direction.

The retainer member 49 has a plurality of protrusions which are formed on its support member arranged in parallel with the shafts of the pair of carriage rollers 47*a* and 47*b*. The protrusions are formed at predetermined intervals so as to come between adjoining rollers.

Figure 5:
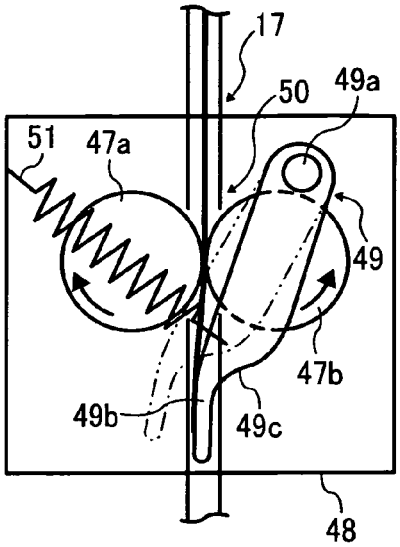
FIG. 5 is an explanatory diagram showing the operation of a retainer member in the sheet folding device, showing a state where the leading edge of a sheet comes into contact with the top side of the retainer member.
Figure 9:
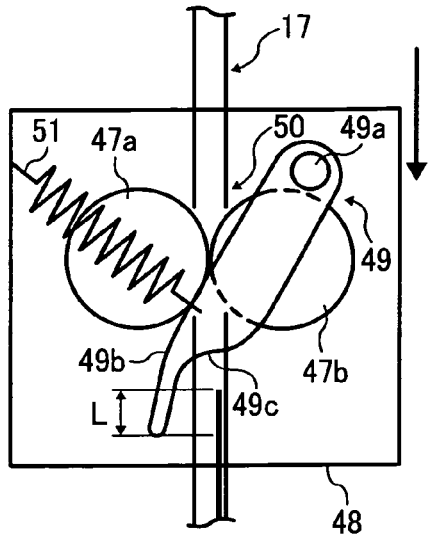
FIG. 9 is an explanatory diagram showing the operation of the retainer member in the sheet folding device, showing a state where the trailing edge of the sheet has pushed and passed by the top end of the retainer member and the moving roller unit is returned by a predetermined amount.
Figure 10:
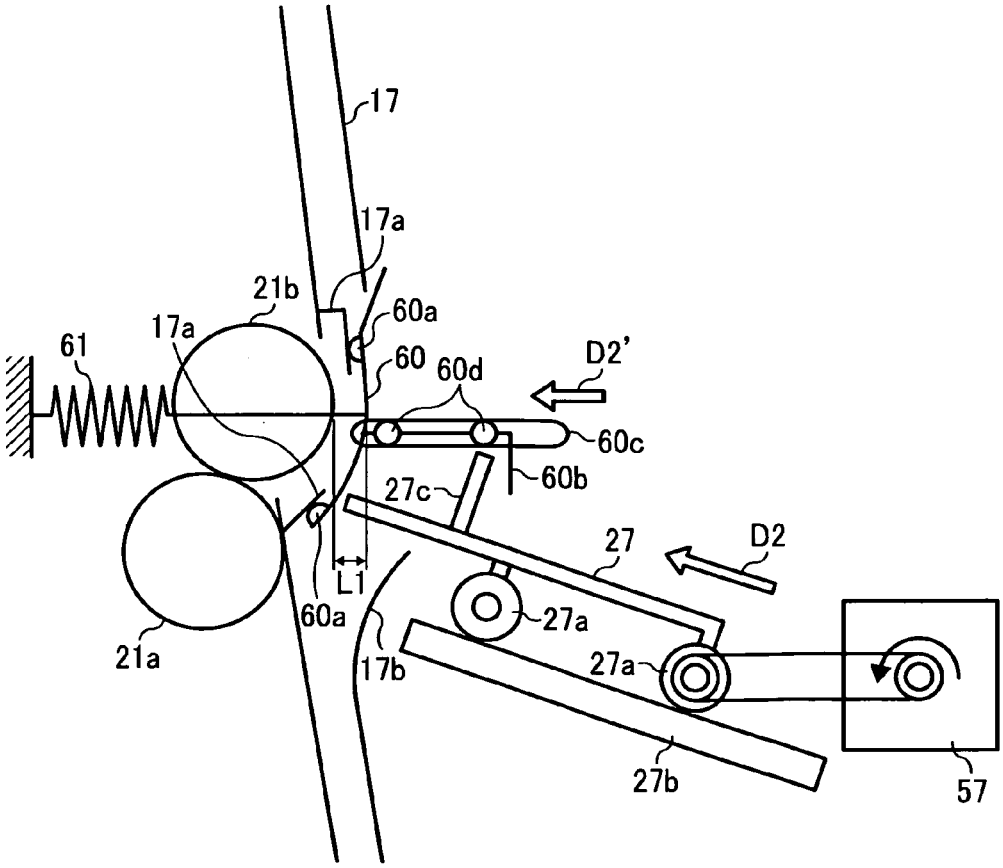
FIG. 10 is an explanatory diagram showing the operation of a movable guide plate in the sheet folding device, showing a state where the movable guide plate is moved in a direction toward the folding roller side.
Figure 11:
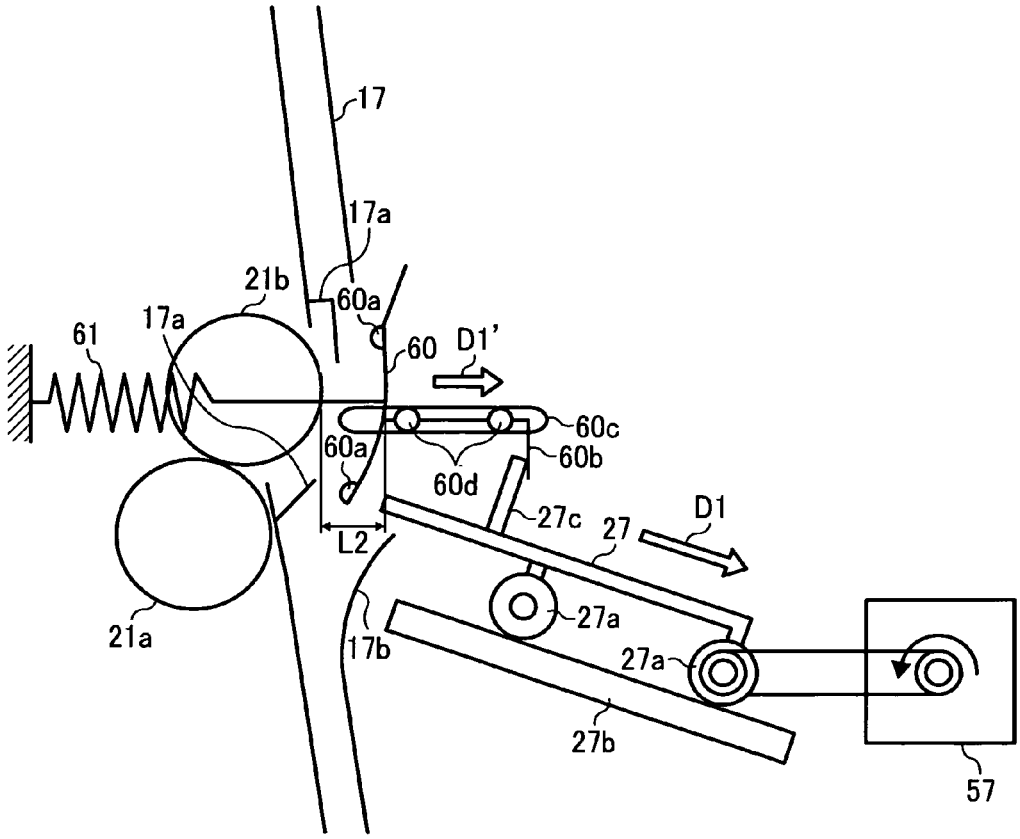
FIG. 11 is an explanatory diagram showing the operation of the movable guide plate in the sheet folding device, showing a state where the movable guide plate is away from the folding roller side for standby.

FIGS. 5 to 9 are explanatory diagrams showing the operation of the retainer member 49. FIGS. 10 and 11 are explanatory diagrams showing the operation of a movable guide plate. As shown in FIG. 5, the retainer member 49 has a base portion 49*a* of axial shape which is swingably supported by the front side plate and rear side plate of the frame 48. With respect to the second conveying path 17, the base portion 49*a* is located on the side of one of the carriage rollers, 47*b*. The retainer member 49 is elastically biased toward the other carriage roller 47*a* by a tension coil spring 51 which is fixed to the frame 48. A stopper member (not shown) restrains the rotation of the retainer member 49 toward the other carriage roller 47*a*, whereby the swinging ends (top ends) of the retainer member 49 are held in a position so as to block the second conveying path 17 as shown by the double-dashed line in FIG. 5. The biasing force (spring constant) of the tension coil spring 51 is set so that when the sheet fed to the second conveying path 17 pushes the retainer member 49, the retainer member 49 rotates in a direction opposite to the biasing direction of the tension coil spring 51 (to open the second conveying path 17). A guide surface (guide section) 49*b* for guiding the sheet fed into the second conveying path 17 to beside retained sheets is formed on the swinging ends of the retainer member 49 at the side closer to the other carriage roller 47*a*. A pressing surface 49*c* for pressing the trailing edges of the bundle of sheets retained in the second conveying path 17 is formed on the top ends of the retainer member 49 at the side farther from the other carriage roller 47*a*.

As shown in FIG. 2, a mechanism for moving the moving roller unit 26 is arranged on a side of the frame 48. The moving mechanism is composed of a pinion 52 and a rack 53. The pinion 52 is installed on the side surface of the frame 48 so as to be capable of being driven, and meshes with the rack 53 which is arranged along the second conveying path 17. The pinion 52 is powered by a first motor (first driving unit) 55. The control unit 56 performs drive control on the first motor 55. When the control unit 56 drives the first motor 55, the moving roller unit 26 moves in vertical directions in the diagram (in the sheet feeding direction) along the second conveying path 17 according to the driving direction of the first motor 55.

As shown enlarged in FIG. 2, a guide plate of movable type (hereinafter, referred to as movable guide plate) 60 for guiding a sheet or sheets to the first stopper 23 is arranged on the second conveying path 17 near the first pair of folding rollers 21*a* and 21*b*. Protrusions 60*a* are formed on both the top and bottom ends of the movable guide plate 60. As shown in FIGS. 10 and 11, guide plates 17*a* are formed on the second conveying path 17 at the side where the first pair of folding rollers 21*a* and 21*b* are arranged, with the roller surface of the folding roller 21*b* therebetween. The movable guide plate 60 is elastically biased toward the upper and lower guide plates 17*a* by a tension spring 61. For single-sheet folding, the movable guide plate 60 is located in the position where the protrusions 60*a* are in contact with the guide plates 17*a*. For multi-sheet folding, the pusher member 27 is moved in the direction of the arrow D1 as shown in FIG. 11, whereby an engaging member 60*b* of the movable guide plate 60 is pulled in the direction of the arrow D1'. The movable guide plate 60 makes a parallel movement from the single-sheet folding position along with the engaging member 60*b*, and is thereby separated from the guide plates 17*a*. The retreating operation of the movable guide plate 60 is effected by a stepping motor to be described later that is intended to drive the pusher member 27. In other words, the stepping motor is used to drive both the movable guide plate 60 and the pusher member 27 as a second motor 57 (see FIG. 3).

The engaging member 60*b* of the movable guide plate 60 is fixed to a pair of guide shafts 60*d* which are slidably supported by a guide bearing 60*c* arranged along the moving direction of the movable guide plate 60. When the pusher member 27 moves in the direction of the arrow D1, a protrusion 27*c* formed on the pusher member 27 comes into engagement with the engaging member 60*b* to make the foregoing operation. For single-sheet folding, the pusher member 27 returns in the direction of the arrow D2. This releases the engagement between the protrusion 27*c* and the engaging member 60*b*, and the movable guide plate 60 is moved in the direction of the arrow D2' by the tension spring 61, returning to the position shown in FIG. 10.

By such a separating operation with the parallel movement of the movable guide plate 60, the gap between the outer periphery of the folding roller 21*b* and the movable guide plate 60 is set to a distance suitable for conveying a bundle of sheets or a distance suitable for folding a bundle of sheets. While in the present embodiment the movable guide plate 60 is moved in parallel, the movable guide plate 60 may have a fulcrum on the upstream side and rotate to increase the feed path gap on the downstream side. In the present embodiment, as shown in FIGS. 10 and 11, the separating operation of the movable guide plate 60 is made not only in accordance with the thickness of the bundle of sheets, but also in response to the feeding position of the bundle of sheets. FIG. 10 shows the positional relationship between the movable guide plate 60 and the pusher member 27 for single-sheet folding. FIG. 11 shows the positional relationship between the movable guide plate 60 and the pusher member 27 for multi-sheet folding.

Since the pusher member 27 uses the stepping motor which can arbitrarily set the stop position, the control unit 56 can modify the driving steps of the second motor 57 to change the gap (feeding gap) to the outer periphery of the folding roller 21*b* arbitrarily. The feeding gap can thus be set to an arbitrary appropriate distance depending on the number of sheets (or folding thickness). The feeding gap is increased with the increasing number of sheets, such as 3 mm for folding up to five sheets, 4 mm for folding up to 10 sheets, and 6 mm for folding 10 to 20 sheets.

Figure 12:
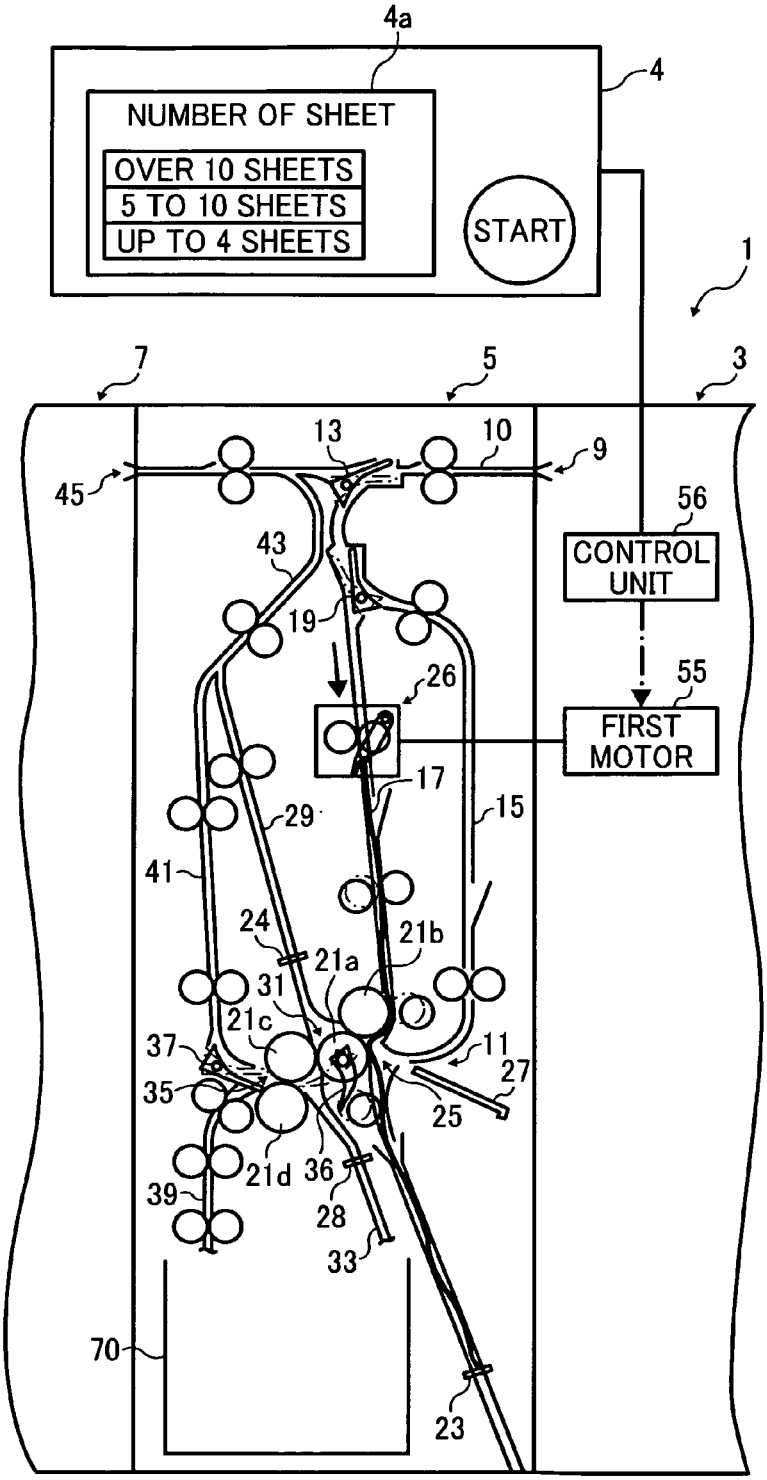
FIG. 12 is a diagram showing the configuration for giving an instruction to the sheet folding device from an operation panel of the image forming apparatus.

Which type of folding the sheet folding device 5 performs, single-sheet folding or multi-sheet folding, can be set by a select input from the operation panel of the image forming apparatus body 3. The number of sheets to fold can also be set from the operation panel. FIG. 12 is a diagram showing a select screen 4*a* on the operation panel 4 for selecting the number of sheets to fold.

Figure 3:
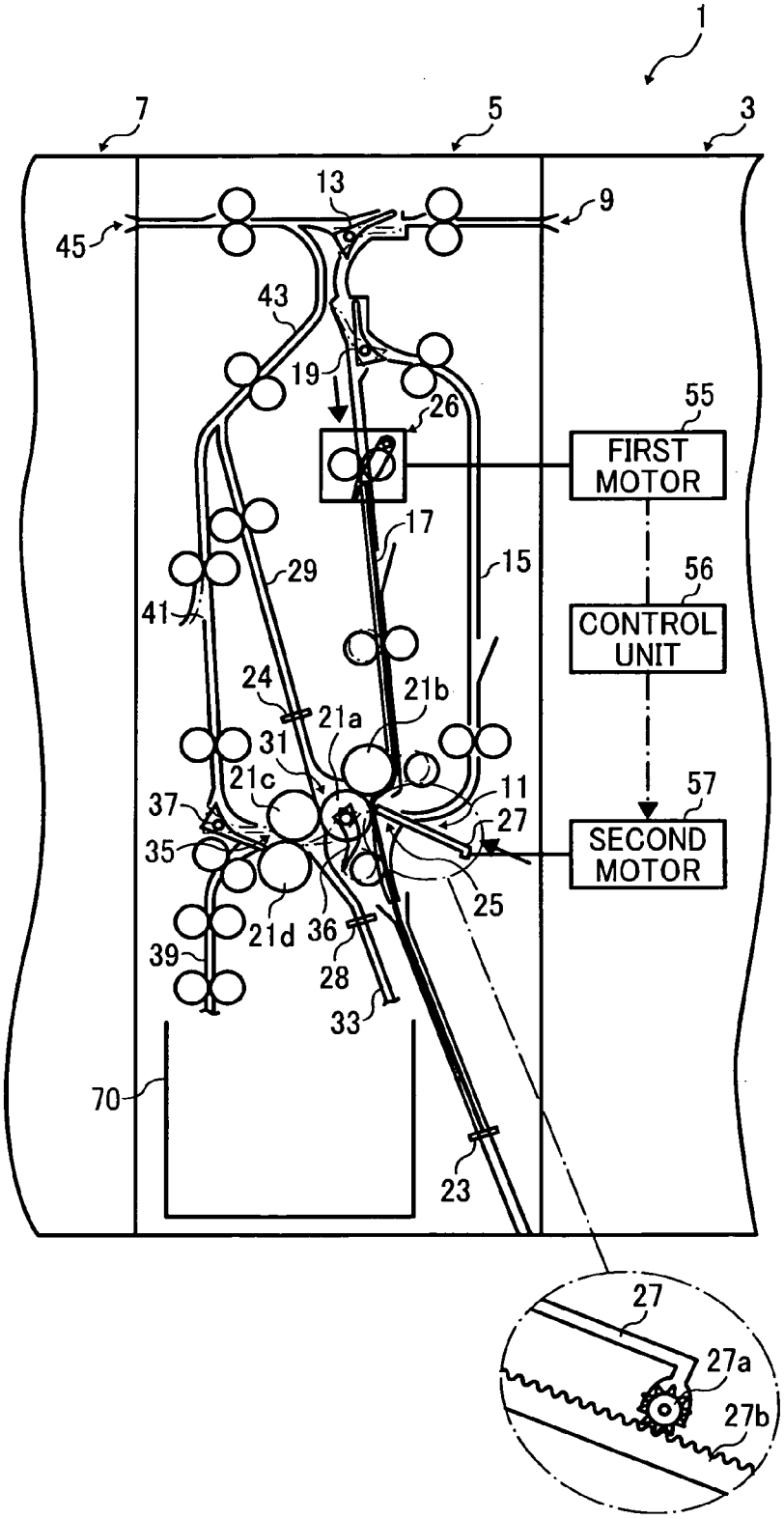
FIG. 3 is an explanatory diagram explaining the folding operation of the sheet folding device according to the system configuration of FIG. 1, showing a state where the trailing edges of the bundle of sheets are pressed to form a bend, and the bend is guided to a first folding nip by a pusher member.
Figure 4:
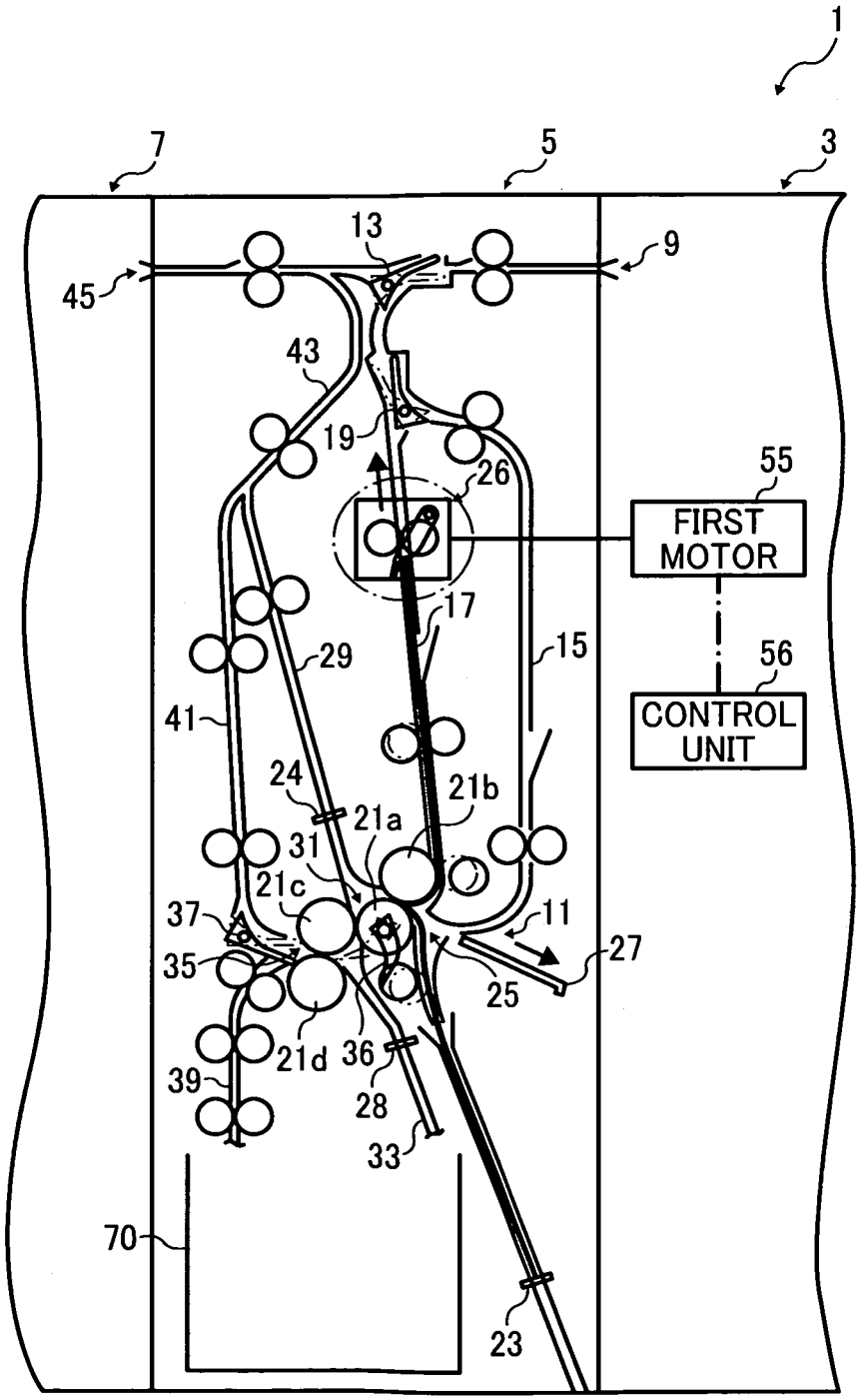
FIG. 4 is an explanatory diagram explaining the folding operation of the sheet folding device according to the system configuration of FIG. 1, showing a state where the bend in the bundle of sheets is held by the first folding nip, and then a moving roller unit is moved to a sheet-accepting position.

The sheet folding device 5 performs the folding processing on a sheet or sheets by the following way. As mentioned previously, FIGS. 2 to 4 are intended to describe the operation of folding a bundle of sheets. FIG. 2 shows a state where a bundle of sheets is retained in the second conveying path 17. FIG. 3 shows a state where the trailing edges of the bundle of sheets are pressed to form a bend, which is guided to the first folding nip by the pusher member. FIG. 4 shows a state where the bend in the bundle of sheets is taken into the first folding nip 25, and then the moving roller unit 26 is moved to a sheet-accepting position.

In the sheet folding operation according to the present embodiment, the user initially selects multi-sheet folding from the operation panel 4 of the image forming apparatus body 3, and then selects a half fold. The control unit 56 sets the sheet-accepting position of the first stopper 23 to a position ½ the length of a sheet in the feeding direction from the first folding nip 25. The control unit 56 sets the distance from the first stopper 23 to the pressing surface 49*c* of the retainer member 49 to be slightly greater than the length of the sheet in the feeding direction. Such settings make it possible to retain sheets and then fold the bundle of sheets without transportation. It should be appreciated that if multi-sheet folding is selected and then a three-fold or Z fold is selected, the first stopper 23 is similarly moved to the corresponding folding position and the distance from the first stopper 23 to the pressing surface 49*c* is set to be slightly greater than the sheet length in the feeding direction as with a half fold. When the pusher member 27 is moved to an HP position (the full-lined position in FIG. 2), the movable guide plate 60 also moves in the direction to reduce the feeding gap (a single-sheet folding position: the full-lined position in FIG. 2; the position shown in FIG. 10). When the pusher member 27 is moved to a retracted position BL1 (the broken-lined position in FIG. 2), the movable guide plate 60 moves in the direction to increase the feeding gap (the broken-lined position BL2 in FIG. 2; the position shown in FIG. 11). As mentioned previously, the pusher member 27 is driven by the second motor 57 and drive-controlled by the control unit 56.

As its essential parts are shown enlarged in FIG. 3, the pusher member 27 is provided with a pinion 27*a* at the rear end (in the diagram, left end). The pusher member 27 advances and retreats along a rack 27*b* when the pinion 27*a* is driven to rotate by the second motor 57 which moves with the pusher member 27. The advanced or retreated position, the advancing speed, and the like are controlled by the control unit 56 (see FIGS. 10 and 11).

Figure 6:
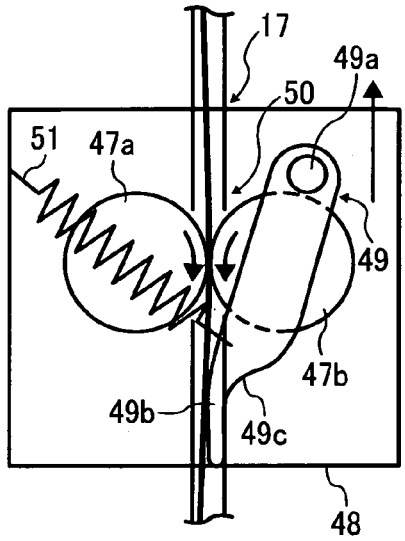
FIG. 6 is an explanatory diagram showing the operation of the retainer member in the sheet folding device, showing a state where the leading edge of the sheet is pushing by the top end of the retainer member to pass.
Figure 7:
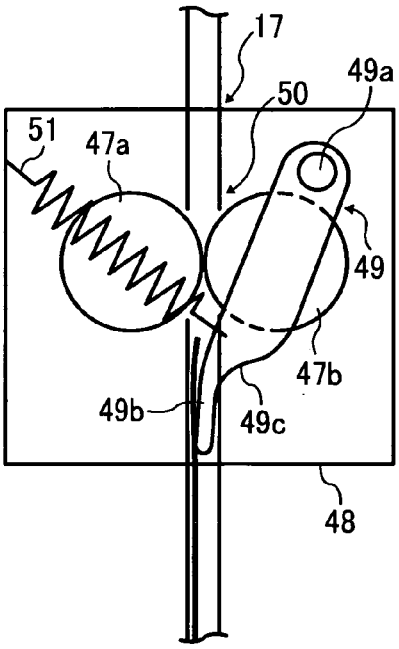
FIG. 7 is an explanatory diagram showing the operation of the retainer member in the sheet folding device, showing the final phase of a state where the trailing edge of the sheet is pushing by the top end of the retainer member to pass.
Figure 8:
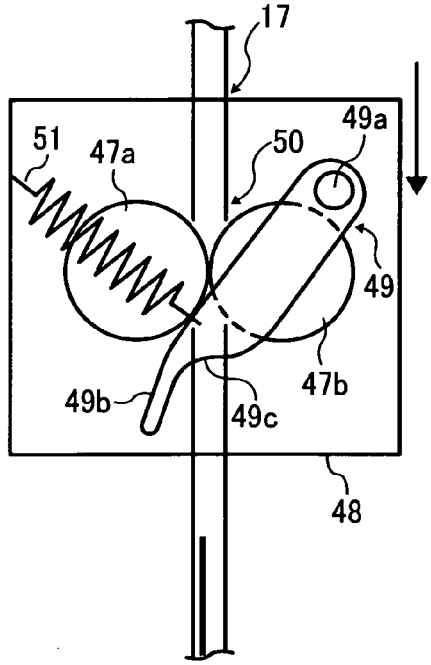
FIG. 8 is an explanatory diagram showing the operation of the retainer member in the sheet folding device, showing a state after the trailing edge of the sheet has pushed and passed by the top end of the retainer member.

After the completion of such setting, the first sheet having an image formed thereon is fed from the image forming apparatus body 3 into the sheet inlet port 9. The fed sheet is guided into the second conveying path 17 by the first switching claw 13 and the second switching claw 19, and the leading edge of the sheet enters a conveying nip 50 between the pair of carriage rollers 47*a* and 47*b*. The leading edge of the sheet comes into contact with the guide surface 49*b* of the retainer member 49, and pushes by the retainer member 49 to proceed downstream as shown in FIG. 6. The control unit 56 rotates the first motor 55 forward at the timing when the leading edge of the sheet reaches the top position of the retainer member 49, and moves the moving roller unit 26 upward (upstream in the sheet feeding direction) by a distance M (15 mm).

The leading edge of the sheet passes the movable guide plate 60, and the transfer of the sheet from the upper half to the lower half of the second conveying path 17 is completed through a receiving guide plate 17*b* at the top end of the lower half. The control unit 56 then drives the second motor 57 so that the pusher member 27 moves from its initial position to the direction of the increased feeding gap as shown in FIG. 11 (the direction of the arrow D1; the broken-lined position in FIG. 2, a feeding gap of L2). The feeding gap of the movable guide plate 60 is thereby increased from L1 (initial position) to L2 (standby position) (L1<L2). The reason for such a driving operation is the following. If the movable guide plate 60 is moved to increase the feeding gap L1, which is between the movable guide plate 60 and the folding rollers 21*a* and 21*b* (in the direction of the arrow D1), before the first sheet is fed, the feeding gap L2, which is between the movable guide plate 60 and the folding roller 21*b*, and the feeding gap at the upstream end of the receiving guide plate 17*b* would have only a small difference. In such a case, the sheet can fail to be guided into the feed path inside the receiving guide plate 17*b*, and, the leading edge of the sheet may often get caught with the upstream end of the receiving guide plate 17*b*, thereby causing jamming.

When the leading edge of the first sheet passes the area of the movable guide plate 60 and the trailing edge of the sheet passes the conveying nip 50 between the carriage rollers 47*a* and 47*b*, the sheet slides down by its own weight to pass by the movable guide plate 60 until the leading edge comes into contact with the first stopper 23. When the leading edge of the sheet reaches the first stopper 23, the control unit 56 reverses the rotation of the first motor 55 to move the moving roller unit 26 downward (downstream in the sheet feeding direction). The control unit 56 stops moving the moving roller unit 26 at the position where the top ends of the retainer member 49 come below the trailing edge of the sheet by a distance L (10 mm) as shown in FIG. 9.

Next, when the second sheet is fed to the moving roller unit 26, as shown in FIG. 5, the leading edge of the sheet comes into contact with the guide surface 49*b* of the retainer member 49 and pushes by the retainer member 49 to proceed as with the first sheet. The control unit 56 rotates the first motor 55 forward at the timing when the leading edge of the sheet reaches the top position of the retainer member 49, and moves the moving roller unit 26 upward (upstream in the sheet feeding direction) by the distance M. Here, the trailing edge of the first sheet is covered by the top ends of the retainer member 49. The leading edge of the second sheet is thus guided by the guide surface 49*b* and conveyed to beside the first sheet without coming into contact with the trailing edge of the first sheet (retained sheet).

When the second sheet is fed, the movable guide plate 60 is on standby at the position of the increased feed path gap shown in FIG. 11 (the position of the feeding gap L2). Since the first sheet guides the second sheet so as not to make contact with the top end of the receiving guide plate 17*b*, the second sheet will not get caught or cause jamming. Since the feeding gap of the movable guide plate 60 is increased for the second and subsequent sheets which might cause a feeding resistance, there will occur no feeding resistance.

When the trailing edge of the sheet passes the conveying nip 50, the sheet slides down by its own weight until the leading edge comes into contact with the first stopper 23. When the leading edge of the sheet reaches the first stopper 23, the control unit 56 reverses the rotation of the first motor 55 to move the moving roller unit 26 downward (downstream in the sheet feeding direction). The control unit 56 stops moving the moving roller unit 26 at the position where the top ends of the retainer member 49 come below the trailing edge of the sheet by the distance L (10 mm). For the third and subsequent sheets, the moving roller unit 26 is operated at the same timing, whereby the sheets are retained in the second conveying path 17. In the case of multi-sheet folding, as shown in FIG. 2, driven rollers in the pairs of carriage rollers arranged on the second conveying path 17 are kept on standby in positions away from the driving rollers so as not to apply a conveying force to the sheets.

After a desired number of sheets are retained in the second conveying path 17, the retainer member 49 is moved down so that the sheets in the retained bundle are aligned in the sheet feeding direction by the pressing surface 49*c*. The sheets are also aligned in the sheet width direction (direction orthogonal to the sheet feeding direction) by using not-shown jogger fences. As shown in FIG. 3, the retainer member 49 (the moving roller unit 26) is further moved down by a predetermined distance (5 mm) to form a predetermined amount of bend in the bundle of sheets. Subsequently, the pusher member 27 is driven to let the movable guide plate 60 move in the direction of the arrow D2', whereby the bend in the bundle of sheets is moved toward the first folding nip 25. The pusher member 27 then pushes the bend in the bundle of sheets into the first folding nip 25, and the bundle of sheets is folded between the first pair of folding rollers 21*a* and 21*b*. When the pusher member 27 is operated toward the first folding nip 25, the movable guide plate 60 moves in the direction of the arrows D2' by the spring force and returns to the single-sheet folding position (the full-lined position in FIG. 2).

Here, the moving speeds of the retainer member 49 and the pusher member 27 are set to a speed higher than the linear speed of the first pair of folding rollers 21*a* and 21*b*. In the present embodiment, the moving speeds are set to a predetermined speed in the range of 1.1 to 1.5 times the linear speed of the first pair of folding rollers 21*a* and 21*b*. That is, the bundle of sheets is pushed in at a speed 1.1 to 1.5 times the sheet conveying speed. Such a setting makes it possible to press the retainer member 49 and the pusher member 27 against the bundle of sheets with reliability. It should be noted that the range of speed of 1.1 to 1.5 times, which has been described as an example of the higher speed, applies to the present embodiment. The range of speed is not limited thereto and is appropriately set depending on the devices.

As shown in FIG. 4, when the bend in the bundle of sheets is held by the first folding nip 25, the retainer member 49 is moved upward and retreated to the sheet-accepting position (initial position) away from the trailing edges of the bundle of sheets. The pusher member 27 is moved to its retreated position at the same time. By the switching operation of the fourth switching claw 37, the bundle of sheets folded in half is guided into the sixth conveying path 41 if it is to be fed to the sheet postprocessing device 7. The bundle of sheets is guided into the fifth conveying path 39 if it is to be discharged into the stacker 70.

Note that the folding operation of the sheet folding device 5 shown in FIGS. 2 to 4 is a half fold operation. It will be understood that various folding types such as a three-panel barrel fold, a three-panel Z fold, an accordion fold, a double parallel fold, and a gate fold may be similarly implemented.

The present embodiment described above provides effects such as:

1) For multi-sheet folding, the movable guide plate 60 for securing a feeding gap is made movable, and the feeding gap is increased so as not to cause a feeding resistance. It is therefore possible to fold sheets with high alignment accuracy without being affected by the thickness or curl of the bundle of sheets.

2) The gap of the guide plate 60 is increased with the increasing number of sheets to fold. This allows sheet folding with high alignment accuracy irrespective of the number of sheets to fold.

3) The guide plate 60 is moved in parallel from the single-sheet folding position. This can make the gap between the guide plate 60 and the outer peripheries of the folding rollers 21*a* and 21*b* uniform in any positions, allowing sheet folding with high alignment accuracy.

4) The single-sheet folding position of the guide plate 60, where positioning is critical, is determined by way of abutting. The multi-sheet folding position is determined by way of driving the second motor (stepping motor) 57. A bend can thus be formed with higher stability for single-sheet folding.

5) The guide plate 60 is moved by driving the pusher member 27 which is activated for multi-sheet folding. Driving the two members by one motor allows low-price small-sized configuration.

It should be appreciated that the present invention is not limited to the present embodiment, and various modifications may be made thereto. It is intended that all technical matters included in the technical ideas set forth in the claims should be covered by the present invention.

According to the present invention, it is possible to perform sheet folding with high alignment accuracy without being affected by the sheet thickness or curl even in the case of multi-sheet folding where a plurality of sheets are folded as stacked.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding device for performing single-sheet folding and multi-sheet folding with a single feed path, the device comprising:

a conveying unit that conveys a sheet;

a restraining unit that stops a leading edge of the sheet;

a pair of folding rollers that fold the sheet;

a guiding member that guides a bend of the sheet to a nip between the pair of folding rollers, wherein the guiding member is positioned at different sheet-guiding positions for single-sheet folding and multi-sheet folding;

a driving unit that makes the guiding member advance and retreat with respect to the pair of folding rollers; and a control unit that controls the driving unit, wherein the control unit is configured to, acquire information indicating whether the single-sheet folding or the multi-sheet folding is performed, control the position of the guiding member so that a gap between the pair of folding rollers and the guiding member during the multi-sheet folding becomes larger than the gap during the single-sheet folding, prior to the sheet passing through the gap, and pass the sheet through the gap, after controlling the position of the guiding member.

2. The sheet folding device according to claim 1, wherein the guiding member moves in a direction to increase a gap between the guiding member and outer peripheries of the folding rollers during multi-sheet folding.

3. The sheet folding device according to claim 2, wherein the guiding member makes a shifting movement when moving from a single-sheet folding position to a multi-sheet folding position, the shifting movement being in a direction that is about perpendicular to a conveying direction of the sheet.

4. The sheet folding device according to claim 2, wherein the gap varies according to a number of the sheet to be folded or a folding thickness of the sheet.

5. The sheet folding device according to claim 4, wherein the gap increases as the number of the sheet to be folded increases, or as the folding thickness of the sheet increases.

6. The sheet folding device of claim 4, wherein the control unit is further configured to, acquire additional information that indicates the number of sheets to be folded, and control the position of the guiding member so that the gap becomes larger after the sheet passes through the gap, if the number of sheets to be folded is two or more.

7. The sheet folding device according to claim 1, wherein the guiding member includes a protruded member for positioning that secures a sheet feeding gap, and an elastic body that holds the protruded member in contact with an opposed guide plate; and the guiding member is held by the elastic body during single-sheet folding, and moved by the driving unit against an elastic force of the elastic body during multi-sheet folding.

8. The sheet folding device according to claim 7, wherein the guiding member operates in conjunction with an advancing operation of a pusher member that pushes the sheet into between the pair of folding rollers for sheet folding; and the pusher member is driven by a single driving source.

9. An image forming apparatus comprising the sheet folding device according to claim 1.

10. A sheet folding method for performing single-sheet folding and multi-sheet folding with a single feed path, the method comprising:

conveying a sheet by a conveying unit;

restraining a leading edge of the conveyed sheet by a restraining unit;

guiding by a guiding member a bend of the sheet in the restrained state into a nip between a pair of folding rollers for sheet folding, thereby folding the sheet, wherein in the guiding, the guiding member is positioned at different sheet-guiding positions for single-sheet folding and multi-sheet folding;

driving, by a driving unit, the guiding member to advance and retreat with respect to the pair of folding rollers; and acquiring, by a control unit, information indicating whether the single-sheet folding or the multi-sheet folding is performed, controlling, by the control unit, the position of the guiding member so that a gap between the pair of folding rollers and the guiding member during the multi-sheet folding becomes larger than the gap during the single-sheet folding, prior to the sheet passing through the gap, and passing, by the control unit, the sheet through the gap, after controlling the position of the guiding member.

* * * * *